US009353316B2

(12) United States Patent
Shi

(10) Patent No.: US 9,353,316 B2
(45) Date of Patent: May 31, 2016

(54) METHOD AND DEVICE FOR CATALYTIC CRACKING

(75) Inventor: Baozhen Shi, Henan (CN)

(73) Assignee: Baozhen Shi, Luoyang (CN)

( * ) Notice: Subject to any disclaimer, the term of this patent is extended or adjusted under 35 U.S.C. 154(b) by 266 days.

(21) Appl. No.: 14/126,250

(22) PCT Filed: May 17, 2012

(86) PCT No.: PCT/CN2012/075635

§ 371 (c)(1),
(2), (4) Date: Feb. 18, 2014

(87) PCT Pub. No.: WO2012/171426

PCT Pub. Date: Dec. 20, 2012

(65) Prior Publication Data

US 2014/0151267 A1 Jun. 5, 2014

(30) Foreign Application Priority Data

Jun. 15, 2011 (CN) ..... 2011 1 0160132

(51) Int. Cl.

*C10G 11/18* (2006.01)
*C10G 11/02* (2006.01)
*C10G 11/00* (2006.01)

(52) U.S. Cl.

CPC ..... *C10G 11/02* (2013.01); *C10G 11/182* (2013.01); *C10G 2300/4093* (2013.01); *C10G 2400/02* (2013.01); *C10G 2400/04* (2013.01)

(58) Field of Classification Search

CPC ..... C10G 11/00; C10G 11/18; C10G 11/182; C10G 2300/4093; C10G 2400/02; C10G 2400/04

See application file for complete search history.

(56) References Cited

U.S. PATENT DOCUMENTS

| | | | |
|---|---|---|---|
| 4,859,310 | A | 8/1989 | Fitzharris et al. |
| 2002/0108887 | A1 | 8/2002 | Zhang et al. |

FOREIGN PATENT DOCUMENTS

| | | | |
|---|---|---|---|
| CN | 2380297 | Y | 5/2000 |
| CN | 1302843 | A | 7/2001 |
| CN | 1340602 | A | 3/2002 |
| CN | 1888025 | A | 1/2007 |
| CN | 101591562 | A | 12/2009 |
| CN | 201485421 | U | 5/2010 |
| WO | 03089546 | A1 | 10/2003 |

*Primary Examiner* — Brian McCaig

(74) *Attorney, Agent, or Firm* — Coats & Bennett, PLLC

(57) ABSTRACT

Provided is a method for catalytic cracking. The method comprises: a regenerated catalyst entering a pre-rising section (VIII) is mixed with raw oil and fed to a raw oil reaction area (I) for a catalytic cracking reaction; the catalyst and the oil-gas flow upwards into a catalyst-separating area (III) where part of the catalyst separates and flows into a stripping area for the catalyst to be regenerated (V, VII); the non-separated catalyst and the oil-gas together continue to flow upwards and are then mixed in an oil-gas repeat reaction area (II) with a regenerated catalyst entering into a supplementary catalyst distribution area (IV) and the oil-gas undergoes a repeat catalytic reaction; then the oil-gas and the catalyst in a riser reactor undergo gas-solid separation in a settler (VI), with the oil-gas entering a fractionating tower system via an oil-gas line, and the catalysts to be regenerated in the raw oil reaction area (I) and the oil-gas repeat reaction area (II) entering a regenerator (13), after being steam-stripped in the stripping area for the catalyst to be regenerated, in order to be reactivated. Also provided is a catalytic cracking device for use in the above-mentioned catalytic cracking method.

15 Claims, 6 Drawing Sheets

METHOD AND DEVICE FOR CATALYTIC CRACKING

TECHNICAL FIELD

The present invention relates to a method and a device for catalytic cracking, and in particularly, to a method and a device for catalytic cracking of petroleum hydrocarbons raw material, which pertain to the technical field of petrochemical industry.

BACKGROUND OF THE INVENTION

The catalytic cracking device is the main device for producing gasoline, and a majority of motor gasoline in the world comes from the catalytic cracking device, and a riser reactor is employed for conventional catalytic cracking.

The biggest shortcoming of the existing riser reactor lies in that the riser is too long. The catalyst activity at the outlet of the riser is only about one-third of the initial activity for the catalyst. Therefore, the activity and selectivity of catalyst have been dramatically reduced in latter half part of the riser reactor so that catalysis degrades and the thermal cracking reactions and other detrimental secondary reactions increase. It not only limits the increase of the single-pass conversion of the raw materials, but also simultaneously causes the olefin content of cracking gasoline to be up to 45% or more, thus far from meeting the requirements for new gasoline standard. With the reduction in catalyst activity, the selectivity of catalytic reaction is inevitably reduced, and side reactions increase naturally.

In order to improve the single-pass conversion in catalytic process, a key problem is to enhance the catalyst activity in latter half part of the existing riser reactor. CHINESE patent application No. 99213769.1 discloses a two-stage series-connected apparatus for catalytic cracking which comprises two identically structural catalytic cracking apparatuses vertically overlapped one upon another. By vertically overlapping the reaction and regeneration apparatuses one upon another, this technique intensifies the catalytic cracking process in the conventional riser by shortening reaction time, thereby improving the effective activity and selectivity of the catalyst. However, the technique disclosed in this patent application is merely limited to theory, and lacks the operable implementation method. The implementation of this technique corresponds to constructing two vertically overlapping reaction-regeneration apparatuses for catalytic cracking with higher investment, thus it is less likely to be implemented.

CHINESE patent application No. 00122845.5 discloses a two-stage catalytic cracking process for hydrocarbon oil as follows. Hydrocarbon oil firstly contacts and reacts with a cracking catalyst in a first reactor, and thus generated oil-gas is conveyed to a second reactor to contact and react with a catalyst containing high silica zeolite of five-membered ring, and thus generated oil-gas is then conveyed to a fractionating tower for separation. The catalysts in the two reactors are different in composition and property in this method. Although the product selectivity in the second reactor is enhanced by allowing the reacted oil-gas in the first reactor to be in contact with the fresh catalyst in the second reactor, two kinds of catalysts and two parallel-arranged reaction-regeneration systems make the investment cost higher.

CHINESE patent application No. 00134054.9 discloses a new catalytic cracking technique using a two-stage riser in which a riser is divided into an upper stage and a lower stage. Catalyst in a first stage comes from a regenerator, and after the reaction in the first segment ends, the catalyst and oil-gas are separated through an intermediate separator arranged at the end of the first stage with only the oil-gas continuing to enter the second reaction stage for reaction; the catalyst in the second reaction stage is a regenerated catalyst from the regenerator which is subjected to a heat exchange via an external heat exchanger. This technique is to allow high active and cooled low-temperature regenerated catalyst to continue to contact and react with the oil-gas in the second reaction stage (i.e., the latter half part of the riser), whereby the catalyst activity in the second stage and single-pass conversion are improved. However, the catalyst separated from the first stage is necessarily subjected to a steam stripping before entering the regenerator in this technique, and meanwhile the regenerated catalyst must be conveyed upwards by a conveying medium to be able to enter the second stage, and both stripping steam and the conveying medium will enter the riser in the second stage, which will affect the reactions in the second stage inevitably; if the amount of stripping steam is restricted, it will then affect stripping effect, and further affect the regeneration procedures; in addition, a height difference from the bottom of the external heat exchanger to the inlet of the second stage is up to tens of meters and there needs a large number of conveying medium, so a large amount of power consumption is required; and the investment will be largely increased, because two settlers and two stripping sections are required in this technique.

SUMMARY OF THE INVENTION

In order to solve the above problem, it is therefore an object of the present invention to provide a new catalytic cracking method, which not only improves product distribution and product quality, but also can lower engineering investment and facilitate engineering implementation.

The object of the present invention further lies in providing a catalytic cracking device applicable to the above catalytic cracking method.

To arrive at the above object, the present invention firstly provides a catalytic cracking method, wherein a catalytic cracking reaction is performed in a reaction-regeneration device comprising a reaction part provided with a riser reactor and a regeneration part including a regenerator, wherein the reaction part is comprised of the riser reactor, a stripping area for the catalyst to be regenerated stripping area and a settler; the riser reactor comprises a pre-rising section, a raw oil reaction area, a catalyst-separating area, a supplementary catalyst distribution area and an oil-gas repeat reaction area from bottom to top; the catalyst-separating area is arranged at an outlet of the raw oil reaction area; a passage is provided between the catalyst-separating area and the oil-gas repeat reaction area, the periphery of passage is the supplementary catalyst distribution area;

wherein the regenerator is provided with a lower first regeneration area, an intermediate dense-phase fluidized bed area and an upper dilute-phase catalyst settlement separation area from bottom to top; the first regeneration area may be separated from the intermediate dense-phase fluidized bed area by means of a partition plate (for example, a partition plate with passages);

wherein the regenerated catalyst from the dense-phase fluidized bed area in the middle of the regenerator enters the pre-rising section and the supplementary catalyst distribution area of the riser reactor in the manner as follows, respectively:

entering the pre-rising section: the regenerated catalyst directly entering downwards the pre-rising section (which is located below a nozzle of the raw oil reaction area of the riser reactor) by gravity, or entering (entering can be made by flowing downwards under gravity) the pre-rising section by gravity after cooling (it is possible to allow the regenerated catalyst to enter under the action of gravity a catalyst temperature controller or cooler for cooling), or the regenerated catalyst and the regenerated catalyst after cooling simultaneously entering the pre-rising section via two separate passways (entering can be made by flowing downwards under gravity);

entering the supplementary catalyst distribution area: the regenerated catalyst entering the supplementary catalyst distribution area (the regenerated catalyst does not need to be conveyed via media, and can directly flow downwards into the supplementary catalyst distribution area via a standpipe by gravity) by gravity after cooling (it is possible to allow the regenerated catalyst to enter a catalyst temperature controller for cooling under the action of gravity);

wherein the catalytic cracking reaction process is as below:

allowing the regenerated catalyst which has entered the pre-rising section to contact and mix with a preheated reaction raw oil, and to flow upwards along the riser reactor into the raw oil reaction area to carry out the catalytic cracking reaction;

the catalyst and the oil-gas (reaction oil gas) generated by the catalytic cracking reaction flowing upwards into the catalyst-separating area, part of the catalyst being tangentially separated by means of gas-solid outward vortex and flowing downwards into the stripping area for the catalyst to be regenerated by gravity, maintaining part of the catalyst in the oil-gas (reaction oil gas), the catalyst which has not been separated and the oil-gas (reaction oil gas) continuing to flow upwards and being mixed with the regenerated catalyst which has entered the supplementary catalyst distribution area to together enter the oil-gas repeat reaction area (or together entering the oil-gas repeat reaction area for mixing) to perform an oil-gas catalytic repeat reaction; after the catalytic repeat reaction ends, the oil-gas and the catalyst within the riser reactor undergo the gas-solid separation within a settler, the oil-gas entering a fractionating system via an oil-gas pipeline, the catalysts to be regenerated in the raw oil reaction area and the oil-gas repeat reaction area entering the regenerator (via a catalyst standpipe) for activity recovery after being subjected to steam stripping in the stripping area for the catalyst to be regenerated.

In the above catalytic cracking method provided in the present invention, preferably, the reaction conditions in the raw oil reaction area are controlled as follows: a reaction temperature is 510-550° C., a reaction time is 0.4-0.8 s, and an average flow rate of the oil-gas is 5.0-20 m/s. More preferably, the reaction temperature is controlled as 520-540° C.

In the above catalytic cracking method provided in the present invention, preferably, the temperature or mixing temperature of the regenerated catalyst in the pre-rising section is controlled as 620-700° C.

In the above catalytic cracking method provided in the present invention, preferably, the cooling temperature of the regenerated catalyst (being adjusted by the regenerated catalyst temperature controller) that enters the supplementary catalyst distribution area is controlled as 490-650° C. More preferably, the temperature is controlled as 530-600° C.

In the above catalytic cracking method provided in the present invention, preferably, in a catalytic cracking reaction which is directed to the yields of gasoline and diesel oil (an oil quality-oriented catalytic cracking reaction), a reaction temperature in the oil-gas repeat reaction area is controlled as 490-515° C., and a reaction time is controlled as 0.6-1.2 s; in a catalytic cracking reaction which is directed to the yield of low-carbon olefin (a chemical engineering-oriented catalytic cracking reaction), a reaction temperature in the oil-gas repeat reaction area is controlled as 530-630° C., and a reaction time is controlled as 1.0-2.0 s.

In the above catalytic cracking method, other hydrocarbon components such as recycle oil also can enter the raw oil reaction area or the oil-gas repeat reaction area to participate in catalytic cracking, and a quenching medium can further be provided in the oil-gas repeat reaction area for controlling a reaction time in the oil-gas repeat reaction area. Specifically, it is possible to feed the recycle oil and raw oil in the raw oil reaction area or to feed the recycle oil in the oil-gas repeat reaction area, preferably, to feed the recycle oil in the oil-gas repeat reaction area; flexible feeding manners as follows can be assumed: feeding the raw oil individually; or feeding raw oil at a lower portion of the raw oil reaction area, and feeding the recycle oil at a suitable position in an upper portion of a raw oil feed port; or feeding raw oil at the raw oil reaction area, and feeding the recycle oil at the oil-gas repeat reaction area, and the feeding manners may be specifically adjusted upon properties of the raw materials, process requirements; correspondingly, one or more rows of feed nozzles can be provided at suitable positions of the riser reactor, which may be specifically adjusted upon properties of the raw materials or process requirements to adapt to the requirements for the changes in the raw materials.

In the above catalytic cracking method provided in the present invention, preferably, a gas flow rate in the first regeneration area of the regeneration part is controlled as 1.5-3.0 m/s.

In the above catalytic cracking method provided in the present invention, preferably, the catalysts to be regenerated in the raw oil reaction area and the oil-gas repeat reaction area of the riser reactor share a stripping area or are provided with stripping areas respectively; wherein the stripped catalyst enters the regenerator for regeneration via a standpipe. The standpipe is disposed between the stripping area (stripping section) and the regenerator, and generally is connected to the bottom of the regenerator.

In the above catalytic cracking method provided in the present invention, preferably, part of the catalyst to be regenerated which has reacted in the oil-gas repeat reaction area returns into the oil-gas repeat reaction area by gravity, and circulates in the oil-gas repeat reaction area to increase the catalyst inventory in the oil-gas repeat reaction area or reduce reaction space velocity.

In the above catalytic cracking method provided in the present invention, preferably, the amount of the catalyst to be regenerated in the raw oil reaction area of the riser reactor that enters the oil-gas repeat reaction area is controlled according to the carbon content of the catalyst in the oil-gas repeat reaction area; wherein 5-40% of the catalyst to be regenerated in the raw oil reaction area enters the oil-gas repeat reaction area. More preferably, 15-25% of the catalyst to be regenerated in the raw oil reaction area enters the oil-gas repeat reaction area.

The present invention further provides a catalytic cracking device applicable to the catalytic cracking method provided by the present application, the catalytic cracking device comprising a riser reactor, a settler provided on top of the riser reactor, a stripping section and a regenerator which is connected with the riser reactor via a pipeline, wherein the riser reactor is provided with a pre-rising section, a raw oil reaction area and an oil-gas repeat reaction area from bottom to top, and a catalyst separator is provided outside of an outlet of the raw oil reaction area; the oil-gas repeat reaction area is provided above the stripping section, and the stripping section and the raw oil reaction area are provided coaxially or in parallel;

wherein the regenerator being provided coaxially a lower first regeneration area, an intermediate dense-phase fluidized bed area and an upper dilute-phase catalyst settlement separation area, all of which are arranged coaxially, and a partition plate is provided between the first regeneration area and the dense-phase fluidized bed area, and the first regeneration area has a height of 18-26 m;

wherein the catalytic cracking device further comprises a regenerated catalyst temperature controller or cooler, and a regenerated catalyst admission pipe is provided between the catalyst temperature controller or cooler and the dense-phase fluidized bed area of the regenerator, and a low temperature regenerated catalyst pipeline is provided between the catalyst temperature controller or cooler and the riser reactor, and a slide valve is provided on the low temperature regenerated catalyst pipeline;

wherein a distribution plate provided with openings or passages is provided at a lower portion of the oil-gas repeat reaction area of the riser reactor, and a communication port (via which the low temperature regenerated catalyst pipeline is in communication with the oil-gas repeat reaction area) is arranged on a side wall of the oil-gas repeat reaction area, and the area between the communication port and the distribution plate is the supplementary catalyst distribution area, and the area between the outlet of the raw oil reaction area and the distribution plate is a catalyst-separating area; or, an upper partition plate and a lower partition plate are provided at the lower portion of the oil-gas repeat reaction area, each of which is provided with a passage, wherein the lower partition plate is provided with an ascending passage (for the ascent of catalyst and oil-gas streams) from the raw oil reaction area, and the upper partition plate is provided with an ascending passage (for the ascent of stream in the above raw oil reaction area and supplemented cooled catalyst stream) communicating with the oil-gas repeat reaction area, and the area between the upper and lower partition plates and outside of the passages is a supplementary catalyst distribution area, the low temperature regenerated catalyst pipeline is communicative with the supplementary catalyst distribution area via a communication port arranged on a side wall of the supplementary catalyst distribution area, and the area between the outlet of the raw oil reaction area and the lower partition plate is a catalyst-separating area; and wherein a catalyst reflux pipe is provided between the settler and the stripping section, and a slide valve is provided on the catalyst reflux pipe; or a second stripping section is provided in the oil-gas repeat reaction area, and the second stripping section and the oil-gas repeat reaction area are provided coaxially or in parallel.

In the above catalytic cracking device provided in the present invention, preferably, a catalyst circulating pipe is provided between the settler and the oil-gas repeat reaction area or between the second stripping section and the oil-gas repeat reaction area, and a slide valve is provided on the catalyst circulating pipe, allowing part of the catalyst to be regenerated which has reacted in the oil-gas repeat reaction area to return to the oil-gas repeat reaction area.

In the above catalytic cracking device provided in the present invention, preferably, the number and sectional areas of the openings or passages provided in the distribution plate are specifically designed by controlling a linear velocity of oil-gas of 20-30 m/s, that is, the number and sectional areas of the openings or passages in the distribution plate are set to meet a requirement for the linear velocity of oil-gas of 20-30 m/s.

In the present invention, the design of the catalyst temperature controller or cooler can flexibly adjust the temperature of catalyst entering the riser reactor, and the catalyst cooling apparatus according to CN ZL 200920223355.1 is preferably selected for the internal structure design of the catalyst temperature controller, the entire contents of which are incorporated herein for reference; in addition, corresponding gas distributors are provided in corresponding areas of the stripping section, the distribution plates, the supplementary catalyst distribution area and the catalyst temperature controller and the like as required.

The technical solution of the present invention is achieved as follows: the catalyst to be regenerated from a regenerator contacts and reacts with the preheated raw materials, and the reaction mixture flows upwards along the reactor and enters a catalyst-separating area, and part of reacted catalyst to be regenerated is separated out and enters the stripping section, and the rest of the reactants continue to flow upwards and enter the oil-gas repeat reaction area to perform a catalytic repeat reaction after mixing with part of regenerated catalyst whose temperature has been cooled to an appropriate temperature by the catalyst temperature controller; after the reaction is finished, oil-gas and catalyst enter a settler for separation, the oil-gas enters a fractionating system via an oil-gas outlet, and the catalyst enters the stripping section for stripping and returns to the regenerator for regeneration after being stripped.

The technical solution of the present invention has advantageous effects over prior art. For example:

1. Since high-active and low temperature regenerated catalyst is supplemented into the oil-gas repeat reaction, the catalytic activity and reaction selectivity of the whole riser reactor are improved as a whole, and thermal reactions are effectively inhibited so that the total liquid yield of the reaction is increased by 1.0% or more;

2. The catalyst to be regenerated in the raw oil reaction area is firstly separated out before entering the oil-gas repeat reaction area, and thereby the ratio of the catalyst to be regenerated entering the oil-gas repeat reaction area to the supplemented catalyst to be regenerated entering the oil-gas repeat reaction area can be controlled. As a whole, the controls of catalyst flow rate and catalyst activity of the oil-gas repeat reaction area are achieved, hereby achieving the object of improving product distribution and product quality.

3. Due to the design of the reaction-regeneration device, both elevations of the inlets of the pre-rising section and the supplementary catalyst distribution area of the reactor where the regenerated catalyst enters are lower than the elevation of the outlet of the regenerated catalyst temperature controller from which the regenerated catalyst is discharged, and the catalyst naturally descends by gravity and is introduced into the pre-rising section and the supplementary catalyst distribution area respectively without the need of elevation medium;

4. The setting of the second stripping section allows the catalyst to be regenerated after being subjected to a cracking reaction in the raw oil reaction area and the catalyst to be regenerated after being subjected to a cracking reaction in the oil-gas repeat reaction area to be regenerated after stripping at a stripping section and the second stripping section respectively, and different stripping conditions can be set upon process needs in favor of the operation of the device.

Figure 1:
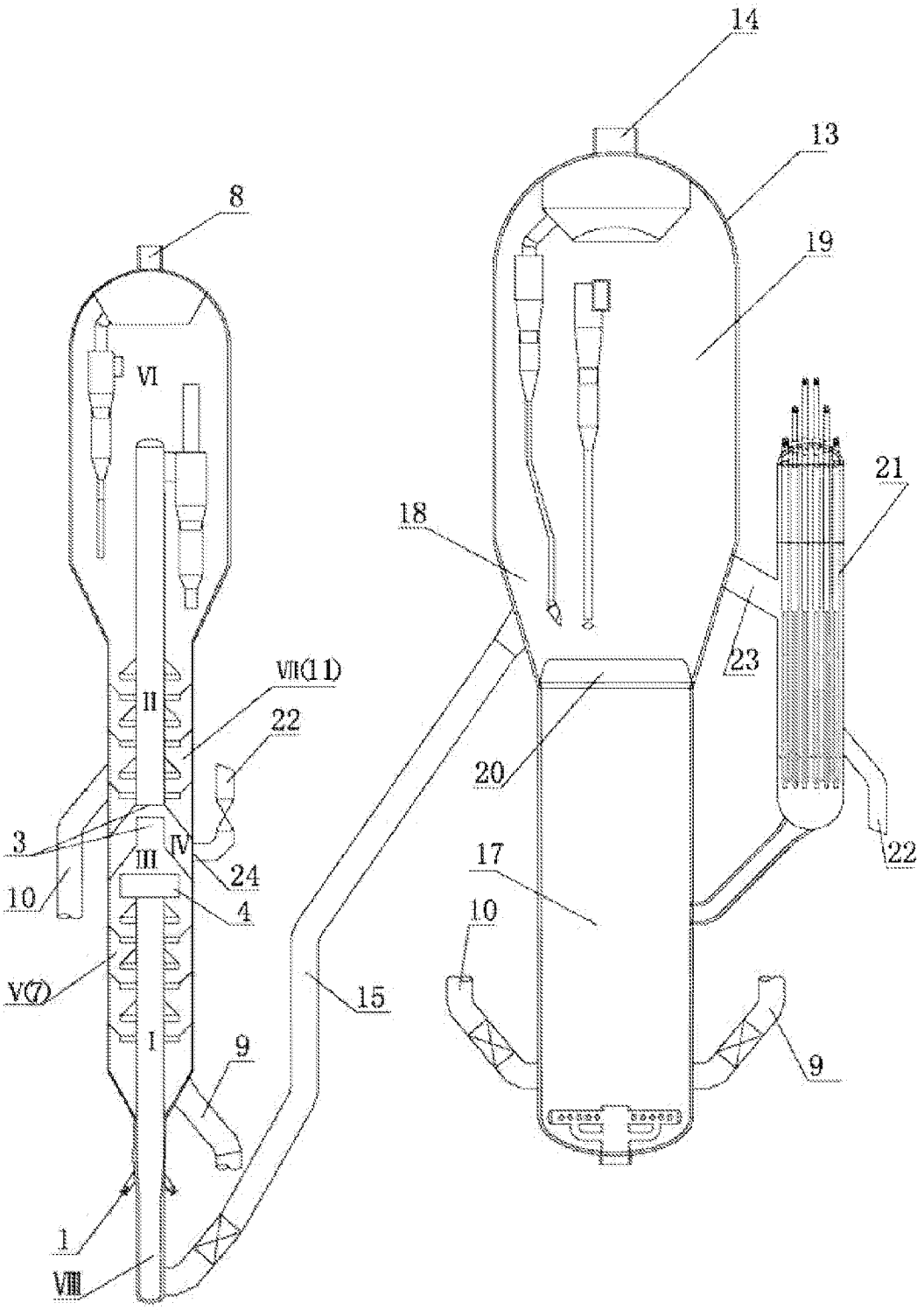
FIG. 1 is a schematic structural diagram of the catalytic cracking device provided by embodiment 1.

Explanation of reference numerals for major components:

1 feeding nozzle
2 distribution plate
3 partition plate passage
4 catalyst separator
6 catalyst reflux pipe
7 stripping section
8 oil-gas outlet
9, 10 spent standpipe
11 second stripping section
12 catalyst circulating pipe
13 regenerator
14 flue gas outlet
15, 16 regenerated standpipe
17 first regeneration area
18 dense-phase fluidized bed area
19 catalyst settlement separation area
20 partition plate
21 catalyst temperature controller
22 low temperature regenerated catalyst pipeline
23 regenerated catalyst admission pipe
24 communication port
I raw oil reaction area
II oil-gas repeat reaction area
III catalyst separating area
IV supplementary catalyst distribution area
V, VII stripping area for the catalyst to be regenerated
VI settler
VIII pre-rising section

DETAILED DESCRIPTION

In order to understand the technical features, the object and advantageous effects of the present invention more clearly, the technical solution of the present invention currently is explained in detail as follows. These explanations, however, should not be understood as being restrictive of the enforceable scope of the present invention.

Embodiment 1

The present embodiment provides a catalytic cracking device (reaction-regeneration device), whose structure is shown in FIG. 1, and the device comprises: a reaction part including a riser reactor, a stripping area and settler VI; and a regeneration part including a regenerator and a catalyst temperature controller or cooler, wherein the riser reactor is divided into pre-rising section VIII, raw oil reaction area I, catalyst-separating area III, and oil-gas repeat reaction area II from bottom to top;

wherein feeding nozzle 1 is provided on a side wall of the bottom of raw oil reaction area I, and catalyst separator 4 is provided at an outlet of raw oil reaction area I, and a stripping section 7 (i.e., stripping area for the catalyst to be regenerated V) is provided outside of raw oil reaction area I, and stripping section 7 and raw oil reaction area I are provided coaxially;

wherein the riser reactor is further provided with second stripping section 11 (stripping area for the catalyst to be regenerated VII) which is coaxially arranged with oil-gas repeat reaction area II;

wherein oil-gas repeat reaction area II is provided above stripping section 7, and an upper partition plate and a lower partition plate are provided at a lower portion of oil-gas repeat reaction area II, each of which is provided with partition plate passage 3, i.e., a passage between catalyst-separating area III and oil-gas repeat reaction area II, and the periphery of partition plate passage 3 is supplementary catalyst distribution area IV;

wherein settler VI is located in the upper portion of stripping section 7, and is provided with oil-gas outlet 8;

wherein regenerator 13 of the regeneration part is provided coaxially with a lower first regeneration area 17, an intermediate dense-phase fluidized bed area 18 and an upper dilute-phase catalyst settlement separation area 19, and partition plate 20 is provided between first regeneration area 17 and dense-phase fluidized bed area 18; flue gas outlet 14 is provided at the top of regenerator 13 for discharging the flue gas in regenerator 13;

wherein regenerated catalyst admission pipe 23 is provided between catalyst temperature controller 21 and dense-phase fluidized bed area 18 of regenerator 13, and low temperature regenerated catalyst pipeline 22 is provided between catalyst temperature controller 21 and supplementary catalyst distribution area IV of the riser reactor, and a slide valve is provided on low temperature regenerated catalyst pipeline 22, and low temperature regenerated catalyst pipeline 22 is in communication with supplementary catalyst distribution area IV via communication port 24 provided on a side wall of supplementary catalyst distribution area IV;

wherein the bottom of pre-rising section VIII is communicative with dense-phase fluidized bed area 18 of regenerator 13 via regenerated standpipe 15, and the bottom of stripping section 7 is communicative with the bottom of regenerator 13 via spent standpipe 9, and the bottom of second stripping section 11 is communicative with the bottom of regenerator 13 via spent standpipe 10.

In the present invention, the design principle of catalyst temperature controller 21 is the same as that of the catalyst cooler, however, the object of providing catalyst temperature controller 21 is to control the temperature of regenerated catalyst, and the catalyst temperature-controlled by catalyst temperature controller 21 directly enters the reactor to participate in a catalytic reaction; the object of providing the catalyst cooler is to take off extra heat of the reaction-regeneration system instead of controlling the temperature of regenerated catalyst, and the catalyst cooled by the catalyst cooler returns to the regenerator again. The object of providing the catalyst temperature controller in the embodiments as below is the similar thereto, and thus no explanation is made herein one by one.

The present embodiment also provides a catalytic cracking method performed using the above catalytic cracking device comprising the following steps:

regenerated catalyst with a temperature of 690° C. or so from dense-phase fluidized bed area 18 flowing into pre-rising section VIII along regenerated standpipe 15; entering inside of raw oil reaction area I of the riser reactor after being mixed with heavy oil atomized by a feeding nozzle 1 which has been preheated to 220° C., flowing upwards along raw oil reaction area I and constantly reacting, with a reaction time of 0.8 s and a reaction temperature of 520° C.;

the reaction mixture flowing upwards to be separated by catalyst separator 4, and the separated catalyst entering regenerator 13 along spent standpipe 9 for regeneration after being stripped in stripping section 7, oil-gas and catalyst without being separated out entering upwards inside of oil-gas repeat reaction area II via partition plate passage 3; meanwhile, the lower temperature regenerated catalyst from catalyst temperature controller 21 entering oil-gas repeat reaction area II along low temperature regenerated catalyst pipeline 22 through supplementary catalyst distribution area IV, and contacting and mixing with the reaction oil-gas and the catalyst to be regenerated from the above raw oil reaction area I that have entered oil-gas repeat reaction area II and continuing reacting, with a reaction temperature of 510° C. and a reaction time of 0.6 s;

the oil-gas entering settler VI after the completion of the reaction, the oil-gas from which the catalyst is separated out being discharged by the oil-gas outlet 8, the catalyst to be regenerated flowing into second stripping section 11, the oil-gas carried in the stripped catalyst returning to regenerator 13 for regeneration through spent standpipe 10, regenerated flue gas being discharged by flue gas outlet 14.

In comparison to the prior art, the single-pass conversion rate is averagely increased by 10% or more and liquid yield is increased by 2% or so in the above catalytic cracking reaction which is carried out in the catalytic cracking device according to this embodiment.

Embodiment 2

Figure 2:
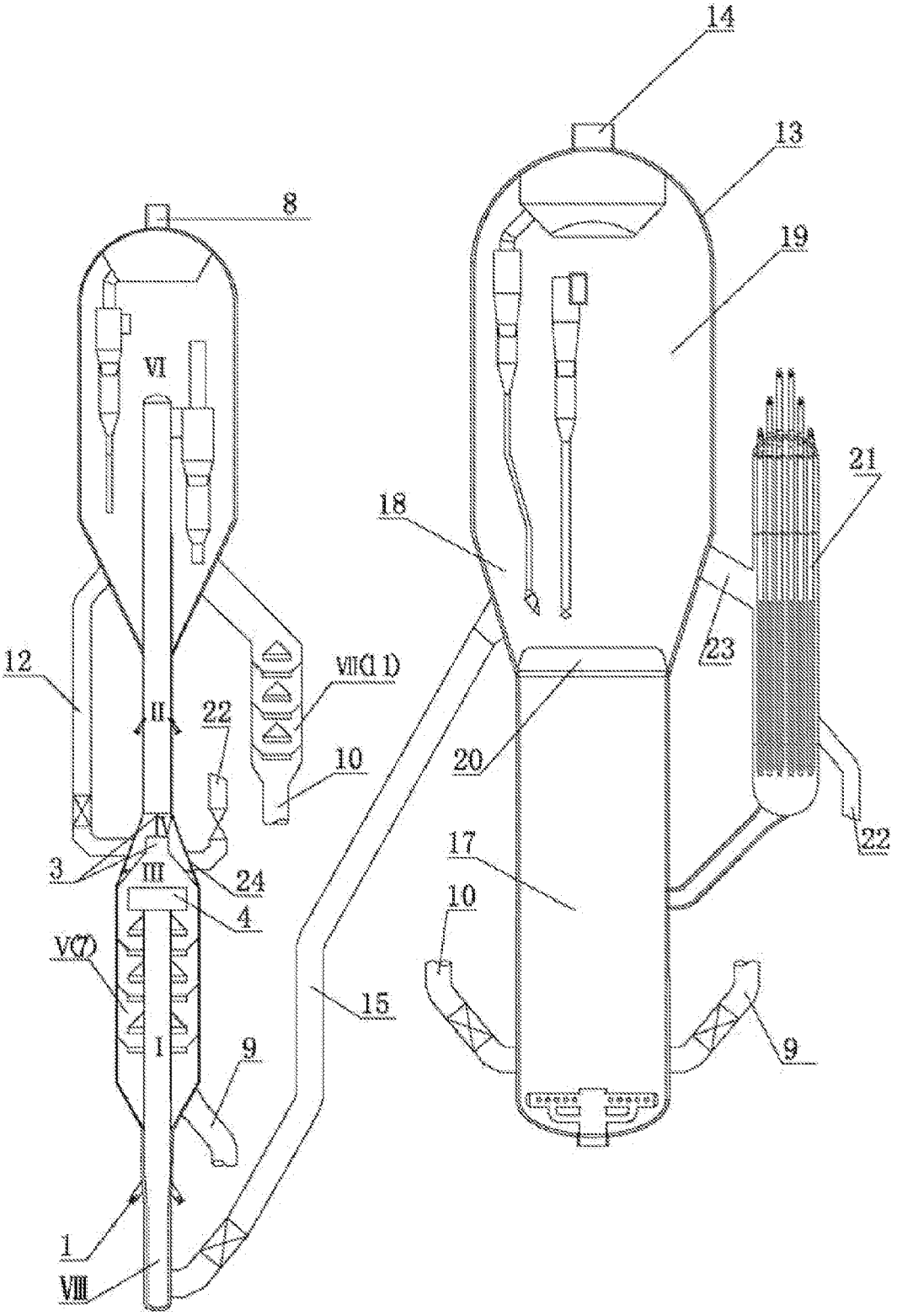
FIG. 2 is a schematic structural diagram of the catalytic cracking device provided by embodiment 2.

The present embodiment provides a catalytic cracking device (reaction-regeneration device), whose structure is shown in FIG. 2, wherein stripping section 7 is coaxially arranged with raw oil reaction area I, and second stripping section 11 is arranged in parallel with oil-gas repeat reaction area II; catalyst circulating pipe 12 is provided between settler VI and supplementary catalyst distribution area IV to allow part of catalyst to be regenerated to return to oil-gas repeat reaction area II to participate in reactions. The rest of structures of the device are same as those in embodiment 1.

Embodiment 3

Figure 3:
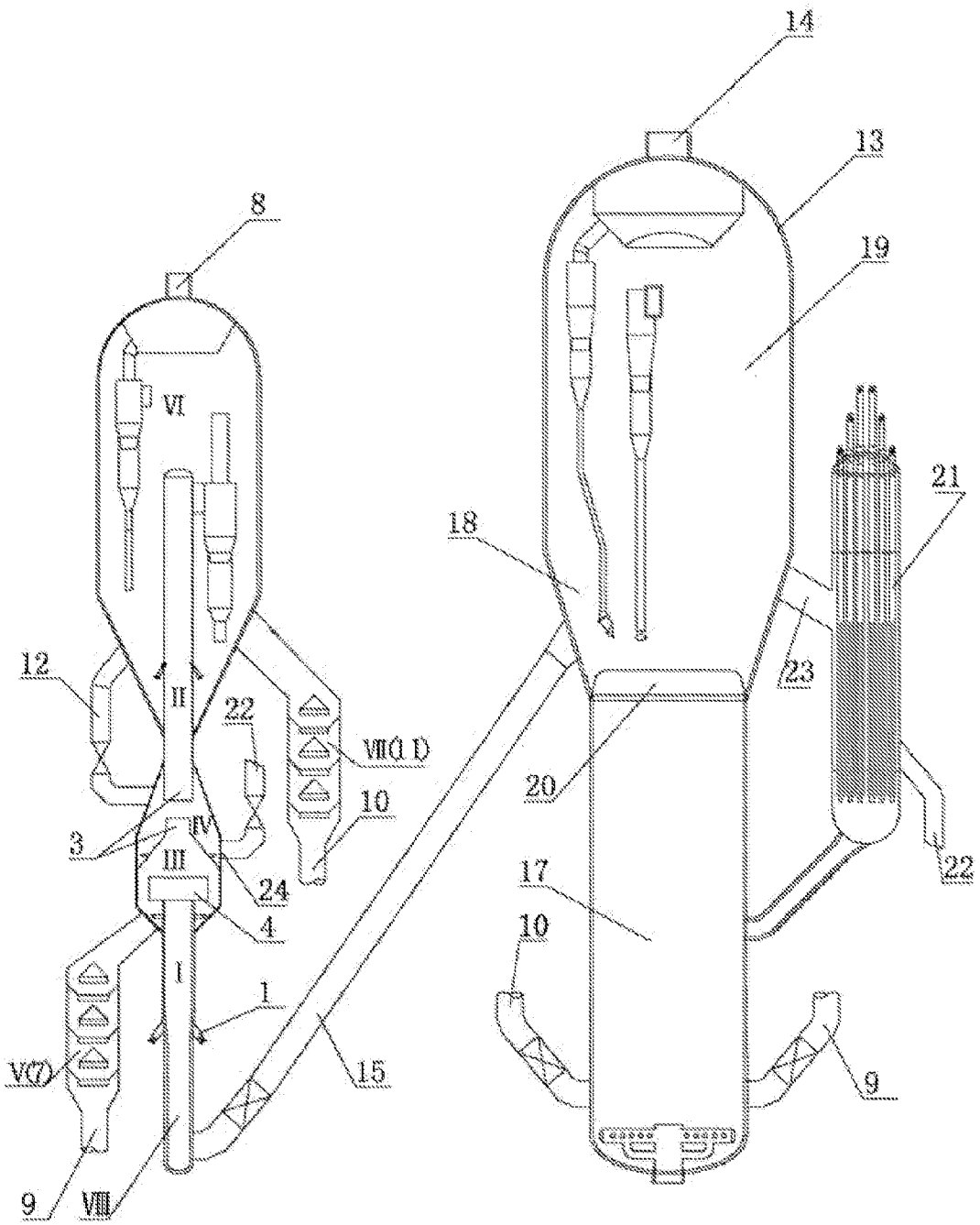
FIG. 3 is a schematic structural diagram of the catalytic cracking device provided by embodiment 3.

The present embodiment provides a catalytic cracking device (reaction-regeneration device), whose structure is shown in FIG. 3, wherein stripping section 7 is arranged in parallel with raw oil reaction area I, and second stripping section 11 is arranged in parallel with oil-gas repeat reaction area II; catalyst circulating pipe 12 is provided between settler VI and supplementary catalyst distribution area IV to allow part of catalyst to be regenerated to return to oil-gas repeat reaction area II to participate in reactions. The rest of structures of the device are same as those in embodiment 1.

Embodiment 4

Figure 4:
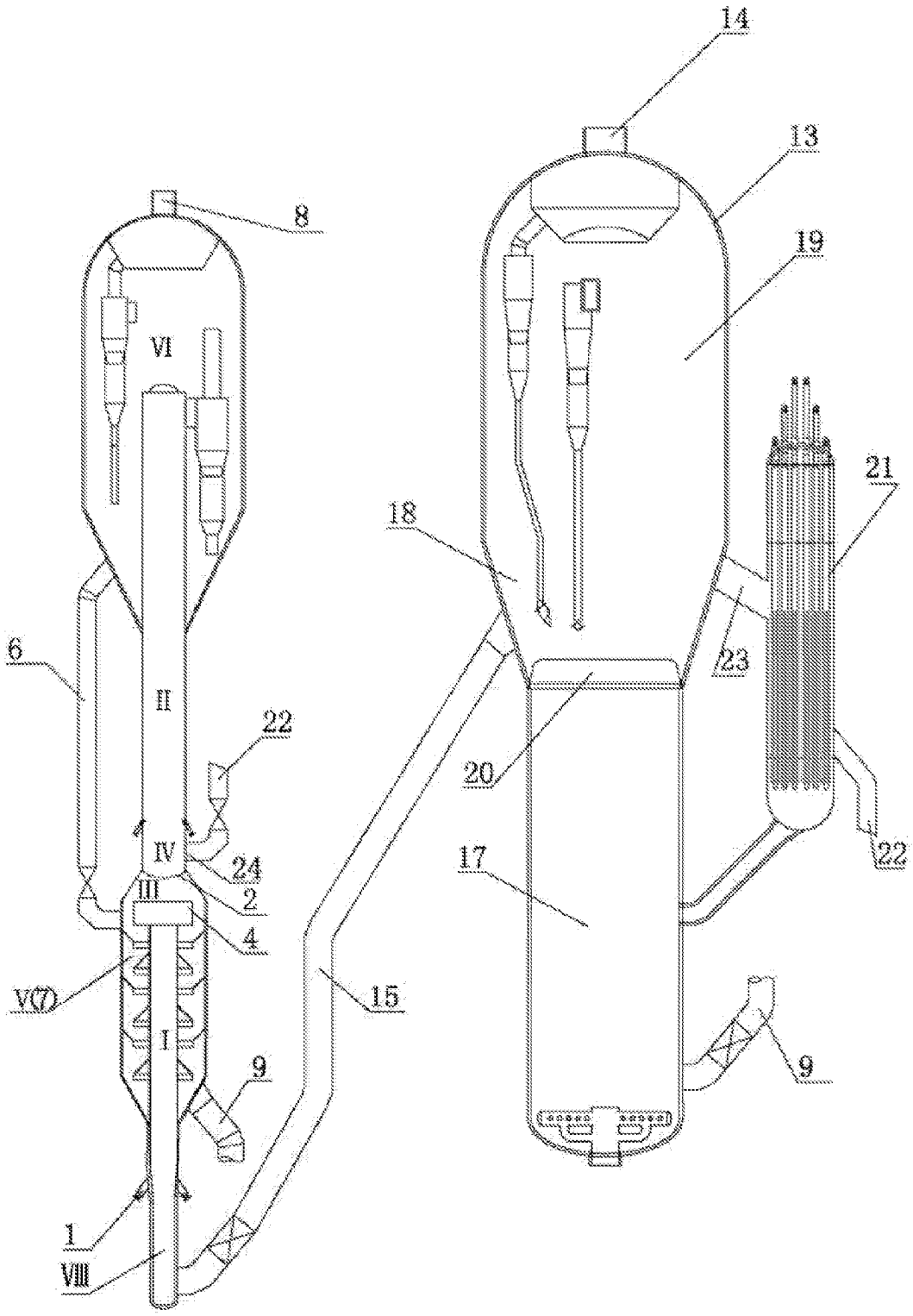
FIG. 4 is a schematic structural diagram of the catalytic cracking device provided by embodiment 4.

The present embodiment provides a catalytic cracking device (reaction-regeneration device), whose structure is shown in FIG. 4, wherein distribution plate 2 is provided at a lower portion of oil-gas repeat reaction area II, and a plurality of openings or passages are provided on distribution plate 2; the reaction part does not include second stripping section 11 (i.e., stripping area for the catalyst to be regenerated VII); stripping section 7 is coaxially arranged with raw oil reaction area I, and is shared by oil-gas repeat reaction area II and raw oil reaction area I, catalyst reflux pipe 6 is provided between settler VI and stripping section 7 to allow the catalyst to be regenerated which has reacted in oil-gas repeat reaction area II to enter stripping section 7 via reflux pipe 6 to be stripped and then to enter regenerator 13 for regeneration. The structures of the regeneration part are the same as that in embodiment 1.

Embodiment 5

Figure 5:
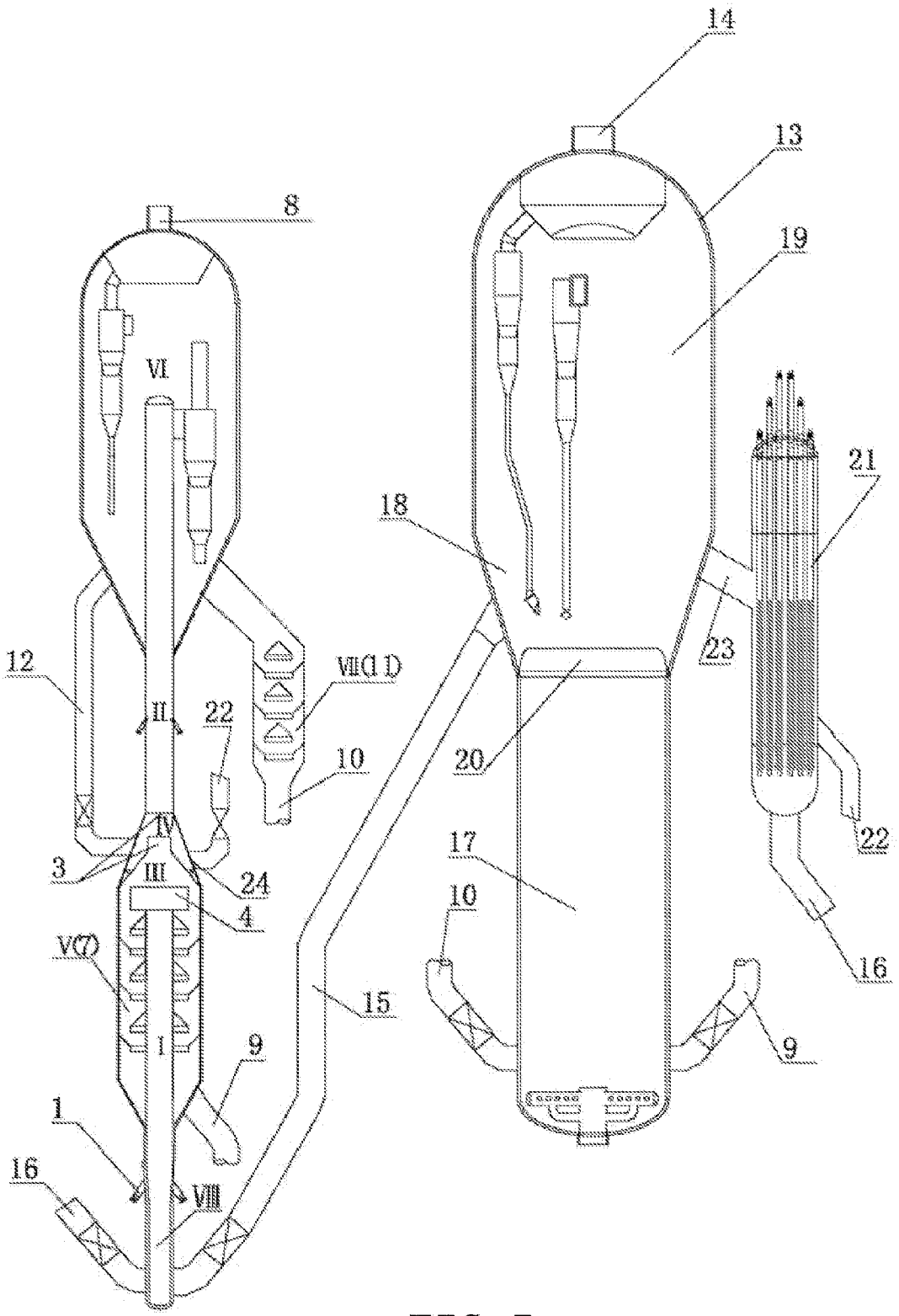
FIG. 5 is a schematic structural diagram of the catalytic cracking device provided by embodiment 5.

The present embodiment provides a catalytic cracking device (reaction-regeneration device), whose structure is shown in FIG. 5, wherein regenerated standpipe 16 is provided between catalyst temperature controller 21 and pre-rising section VIII, and a slide valve is provided on regenerated standpipe 16. The rest of structures of the device are same as those in embodiment 2.

In the catalytic cracking reaction carried out in the catalytic cracking device provided by the present embodiment, there are two catalyst streams that enter pre-rising section VIII: the regenerated catalyst extracted directly via regenerated standpipe 15 and the regenerated catalyst cooled by the adjustment of the catalyst temperature controller 21, and the two catalyst streams flow upwards after being evenly mixed in the pre-rising section VIII to participate in catalytic reactions.

Embodiment 6

Figure 6:
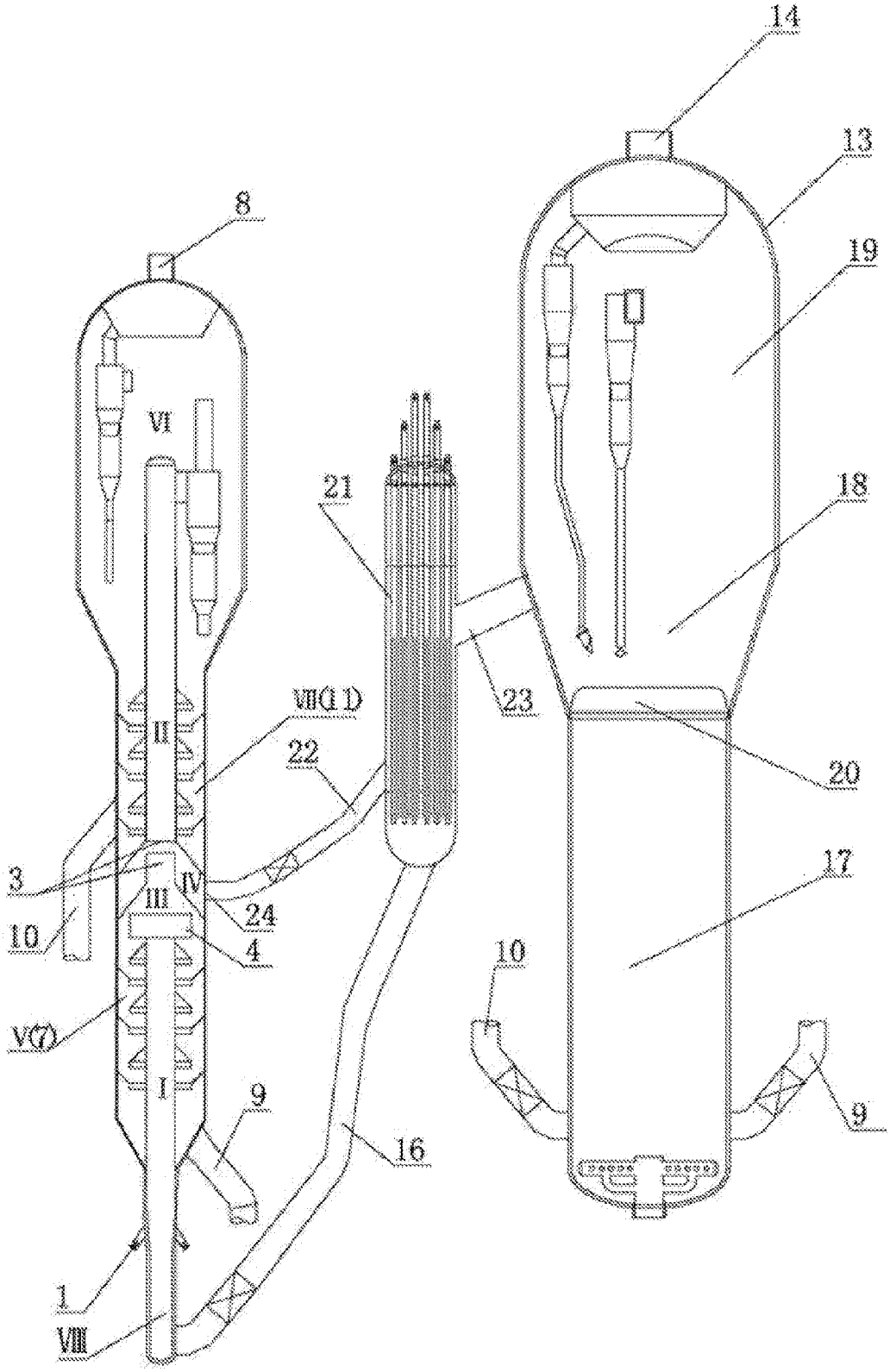
FIG. 6 is a schematic structural diagram of the catalytic cracking device provided by embodiment 6.

The present embodiment provides a catalytic cracking device (reaction-regeneration device), whose structure is shown in FIG. 6, wherein the structure of the device is the same as that in embodiment 1. However, an upper portion of regenerated standpipe 16 connected with pre-rising section VIII is communicative with catalyst temperature controller 21, but is not directly communicative with dense-phase fluidized bed area 18 of regenerator 13.

In the catalytic cracking reaction carried out in the catalytic cracking device provided by the present embodiment, the catalyst stream that enters pre-rising section VIII is the regenerated catalyst cooled by the adjustment of the catalyst temperature controller 21.

The invention claimed is:

1. A catalytic cracking method, wherein a catalytic cracking reaction is performed in a reaction-regeneration device which comprises a reaction part provided with a riser reactor and a regeneration part including a regenerator, wherein the reaction part is comprised of the riser reactor, a stripping area for the catalyst to be regenerated and a settler; the riser reactor comprises a pre-rising section, a reaction area, a catalyst-separating area, a supplementary catalyst distribution area and a second reaction area from bottom to top; the catalyst-separating area is arranged at an outlet of the reaction area; a passage is provided between the catalyst-separating area and the second reaction area, and the periphery of the passage is the supplementary catalyst distribution area;

wherein the regenerator is provided with a first regeneration area, a dense-phase fluidized bed area and a dilute-phase catalyst settlement separation area from bottom to top;

wherein a regenerated catalyst from the dense-phase fluidized bed area enters the pre-rising section and the supplementary catalyst distribution area of the riser reactor in the manner as follows, respectively:

entering the pre-rising section: the regenerated catalyst directly entering the pre-rising section, or entering the pre-rising section by gravity after cooling, or the regenerated catalyst and the regenerated catalyst after cooling simultaneously entering the pre-rising section via two separate passways;

entering the supplementary catalyst distribution area: the regenerated catalyst entering the supplementary catalyst distribution area by gravity after cooling;

the catalytic cracking reaction method comprising:

mixing the regenerated catalyst in the pre-rising section with a preheated reaction feedstock after the regenerated catalyst has entered the pre-rising section;

carrying out the catalytic cracking reaction in the reaction area after the mixture of the regenerated catalyst and the preheated reaction feedstock flows upwards along the riser reactor into the reaction area;

generating reaction products during the catalytic cracking reaction, wherein the catalyst and the reaction products generated by the catalytic cracking reaction flow upwards into the catalyst-separating area;

tangentially separating part of the catalyst by means of gas-solid outward vortex, wherein the part of the catalyst that has been separated flows downwards due to gravity into the stripping area for the catalyst to be regenerated;

maintaining part of the catalyst in the reaction products, wherein the reaction products and the catalyst that has not been separated continue to flow upwards;

mixing the reaction products, the catalyst that has not been separated, and the regenerated catalyst which has entered the supplementary catalyst distribution area before the mixed reaction products, the catalyst that has not been separated, and the regenerated catalyst which has entered the supplementary catalyst distribution area enter the second reaction area;

carrying out a second catalytic reaction in the second reaction area; and separating the reaction products and the catalyst within the riser reactor in the settler via a gas-solid separation after the second catalytic reaction ends, wherein the reaction products enter a fractionating system via a reaction product pipeline, and wherein the catalyst to be regenerated in the reaction area and the second reaction area enters the regenerator for activity recovery after being subjected to steam stripping in the stripping area for the catalyst to be regenerated.

2. The catalytic cracking method according to claim 1, wherein the reaction conditions in the reaction area are controlled as follows: a reaction temperature is 510-550° C., a reaction time is 0.4-0.8 s, and an average flow rate of the reaction products is 5.0-20 m/s.

3. The catalytic cracking method according to claim 2, wherein the reaction temperature is controlled as 520-540° C.

4. The catalytic cracking method according to claim 1, wherein the temperature or mixing temperature of the regenerated catalyst in the pre-rising section is controlled as 620-700° C.

5. The catalytic cracking method according to claim 1, wherein the cooling temperature of the regenerated catalyst that enters the supplementary catalyst distribution area is controlled as 490-650° C.

6. The catalytic cracking method according to claim 5, wherein the cooling temperature is controlled as 530-600° C.

7. The catalytic cracking method according to claim 1, wherein in a catalytic cracking reaction which is directed to the yields of gasoline and diesel oil, a reaction temperature in the second reaction area is controlled as 490-515° C., and a reaction time is controlled as 0.6-1.2 s; in a catalytic cracking reaction which is directed to the yield of low-carbon olefin, a reaction temperature in the second reaction area is controlled as 530-630° C., and a reaction time is controlled as 1.0-2.0 s.

8. The catalytic cracking method according to claim 1, wherein a gas flow rate in the first regeneration area of the regeneration part is controlled as 1.5-3.0 m/s.

9. The catalytic cracking method according to claim 1, wherein the catalyst to be regenerated in the reaction area and the second reaction area of the riser reactor share a stripping area or are provided with stripping areas respectively; wherein the stripped catalyst enters the regenerator for regeneration.

10. The catalytic cracking method according to claim 1, wherein part of the catalyst to be regenerated which has reacted in the second reaction area returns into the second reaction area by gravity, and circulates in the second reaction area to increase the catalyst inventory in the second reaction area or reduce reaction space velocity.

11. The catalytic cracking method according to claim 1, wherein the amount of the catalyst to be regenerated in the reaction area of the riser reactor that enters the second reaction area is controlled according to the carbon content of the catalyst in the second reaction area; wherein 5-40% of the catalyst to be regenerated in the reaction area enters the second reaction area.

12. The catalytic cracking method according to claim 11, wherein 15-25% of the catalyst to be regenerated in the reaction area enters the second reaction area.

13. A catalytic cracking device comprising a riser reactor, a settler provided on top of the riser reactor, a stripping section and a regenerator which is connected with the riser reactor via a pipeline, wherein the riser reactor is provided with a pre-rising section, a reaction area and a second reaction area from bottom to top, and a catalyst separator is provided outside of an outlet of the reaction area; the second reaction area is provided above the stripping section, and the stripping section and the reaction area are arranged coaxially or side by side;

wherein the regenerator being coaxially provided with a lower first regeneration area, an intermediate dense-phase fluidized bed area and an upper dilute-phase catalyst settlement separation area, and a partition plate is provided between the first regeneration area and the dense-phase fluidized bed area, and the first regeneration area has a height of 18-26 m;

wherein the catalytic cracking device further comprises a regenerated catalyst temperature controller or cooler, and a regenerated catalyst admission pipe is provided between the catalyst temperature controller or cooler and the dense-phase fluidized bed area of the regenerator, and a low temperature regenerated catalyst pipeline is provided between the catalyst temperature controller or cooler and the riser reactor, and a slide valve is provided on the low temperature regenerated catalyst pipeline;

wherein a distribution plate provided with openings or passages is provided at a lower portion of the second reaction area of the riser reactor, and a communication port is arranged on a side wall of the second reaction area, and the area between the communication port and the distribution plate is the supplementary catalyst distribution area, and the area between the outlet of the reaction area and the distribution plate is a catalyst-separating area; or, an upper partition plate and a lower partition plate are provided at the lower portion of the second reaction area, each of which is provided with a passage, wherein the lower partition plate is provided with an ascending passage from the reaction area, and the upper partition plate is provided with an ascending passage communicating with the second reaction area, and the area between the upper and lower partition plates and outside of the passages is a supplementary catalyst distribution area, and the low temperature regenerated catalyst pipeline is communicative with the supplementary catalyst distribution area via a communication port arranged on a side wall of the supplementary catalyst distribution area, and the area between the outlet of the reaction area and the lower partition plate is a catalyst-separating area; and wherein a catalyst reflux pipe is provided between the settler and the stripping section, and a slide valve is provided on the catalyst reflux pipe; or a second stripping section is provided in the second reaction area, and the second stripping section and the second reaction area are arranged coaxially or side by side.

14. The catalytic cracking device according to claim 13, wherein a catalyst circulating pipe is provided between the settler and the second reaction area or between the second stripping section and the second reaction area, and a slide valve is provided on the catalyst circulating pipe.

15. The catalytic cracking device according to claim 13, wherein the number and sectional areas of the openings or passages in the distribution plate are set to meet a requirement for the linear velocity of reaction products of 20-30 m/s.

* * * * *